US008333453B2

(12) United States Patent
Dudenhoefer et al.

(10) Patent No.: US 8,333,453 B2
(45) Date of Patent: Dec. 18, 2012

(54) METHOD OF DISPENSING LIQUID

(75) Inventors: Christie Dudenhoefer, Corvallis, OR (US); Kenneth Ward, Corvallis, OR (US); Alexander Govyadinov, Corvallis, OR (US); David Maxfield, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 172 days.

(21) Appl. No.: 13/054,962

(22) PCT Filed: Jul. 30, 2008

(86) PCT No.: PCT/US2008/009218

§ 371 (c)(1),
(2), (4) Date: Jan. 20, 2011

(87) PCT Pub. No.: WO2010/014061

PCT Pub. Date: Feb. 4, 2010

(65) Prior Publication Data

US 2011/0121021 A1 May 26, 2011

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,418,558 | A * | 5/1995 | Hock et al. | 347/14 |
| 6,244,682 | B1 * | 6/2001 | Walker et al. | 347/19 |
| 6,494,565 | B1 | 12/2002 | Ellson | |
| 6,886,903 | B2 | 5/2005 | Koehler | |
| 6,902,253 | B2 * | 6/2005 | Gonzalez | 347/48 |
| 6,995,024 | B2 | 2/2006 | Smith | |
| 2005/0212869 | A1 | 9/2005 | Ellson | |
| 2006/0203028 | A1 * | 9/2006 | Agarwal et al. | 347/19 |
| 2006/0256149 | A1 | 11/2006 | Huang | |
| 2007/0279447 | A1 | 12/2007 | Kawasaki et al. | |

* cited by examiner

*Primary Examiner* — Julian Huffman

(57) ABSTRACT

A liquid dispensing device (10) having a drop ejection device (12) including an orifice (18) adapted for ejecting drops (20) therefrom above a particular turn-on-energy, a turn-on-energy detection device (28) positioned to receive turn-on-energy information from said ejected drops as a function of energy applied to the drop ejection device, and a controller (40) that receives the turn-on-energy information and conducts a mathematical operation on the turn-on-energy information to determine a drop volume of the drops ejected.

15 Claims, 2 Drawing Sheets

Fig. 4

60 62

| %DMSO | 100 | 90 | 80 | 70 | 60 |
|---|---|---|---|---|---|
| DROP VOLUME (pL) | 21 | 25 | 26 | 27 | 29 |

64

Fig. 5

FOR A TOTAL INTENDED VOLUME OF 1000pL

68

| DROP VOLUME (pL) | 18 | 21 | 25 | 29 |
|---|---|---|---|---|
| TOTAL NUMBER DROPS | 56 | 48 | 40 | 34 |

70 66

METHOD OF DISPENSING LIQUID

BACKGROUND

Liquid dispensing devices, such as thermal ink jet printers, may be utilized to dispense precise and minute amounts of liquid into individual wells of a multiple-well tray, such as in pharmaceutical testing, for example. Precise volume amounts should be dispensed into the individual wells in order to ensure accurate test results. There is a need, therefore, to increase the reliability and/or predictability of the volume dispensed.

BRIEF DESCRIPTION OF THE DRAWINGS

FIG. 4 is a table showing for one embodiment a correlation between the water content of the DMSO drops and the volume of the drops.

FIG. 5 is a table showing a correlation between the intended total volume and the total number of drops to achieve the intended total volume for a drop volume determined from FIG. 4.

DETAILED DESCRIPTION OF THE DRAWINGS

Figure 1:
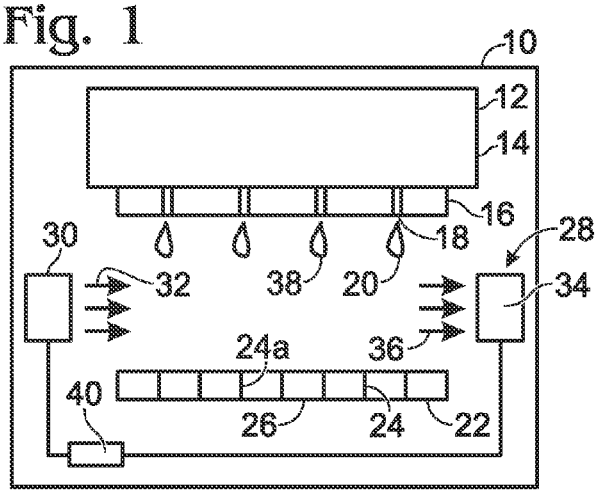
FIG. 1 is a schematic side cross-sectional view of one example embodiment of a liquid dispensing device.

FIG. 1 is a schematic side cross-sectional view of one example embodiment of a liquid dispensing device 10, which in the embodiment shown may include a drop ejection device 12. Drop ejection device 12 may be a printing or an imaging device, and in the example embodiment shown, may be a thermal ink jet device. Drop ejection device 12 may include a printhead or multiple printheads 14 that may include an orifice plate 16 including multiple orifices 18 therein for ejecting fluid 20 therefrom. Drop ejection device 12 may be one of a thermal ejection device, and a piezo ejection device, for example.

Orifice plate 16 may include one or several orifices 18 or may include thousands of orifices 18, as may be suited for a particular application. Fluid 20 may be any fluid as desired for a particular application. The drop ejection device 12 generates droplets 38 of fluid 20 of differing drop volumes depending on fluid 20 and construction details of device 12. In the field of pharmaceutical testing, fluid 20 may include any water-miscible organic solvent, such as dimethyl sulfoxide (DMSO), for example. In other embodiments, fluid 20 may be methanol, isopropanol, ethanol, glycerol, acetone, pyridine, tetrahydrofuran, acetonitrile, and dimethylformamide, for example. DMSO is highly hygroscopic and may gain approximately 30% water by weight over time. The water content in DMSO greatly alters the physical properties of the solution as well as the ejection device performance, including turn-on-energy and drop volume, among others. Accordingly, by determining the turn-on-energy of the drops ejected from the ejection device, the water content and corresponding drop volume may be calculated and used to dispense a volume that accurately corresponds to the intended dispense volume.

Liquid dispensing device 10 may be utilized to dispense precise and minute amounts of liquid into a liquid receiving device 22, such as into individual wells 24 of a multiple-well tray 26, as used in pharmaceutical testing, for example. In some example embodiments liquid receiving device 22 may be a biochemical testing device or a diagnostic strip device, for example. Precise volume amounts should be dispensed into the individual wells 24 in order to ensure accurate test results. There is a need, therefore, to increase the reliability and/or predictability of the volume of fluid 20 dispensed into each of the individual wells 24.

Liquid dispensing device 10 may include one or more drop detection devices 28. The drop detection device may be chosen from one of an electrostatic detection device, a capacitive detection device, an acoustic drop detection device, and an optical detection device, for example. In the embodiment shown, drop detection device 28 may include a light emitting device 30 that emits a light 32, such as a laser, and a light detecting device 34 positioned with respect to orifice plate 16 such that light detecting device 34 receives light 36 reflected, scattered or otherwise emanating from drops 38 of fluid 20 ejected from orifice plate 16 and illuminated by light 32. Light detecting device 34 may be a photodetector chosen from one of a photo diode, a CMOS, a charge-coupled device, a photo multiplying tube, and any other photodetector. Light emitting device 30 may be chosen from one of a laser, a light emitting diode, an arc discharge lamp, and any other high intensity light source.

Light detecting device 34 may be connected to a controller 40 that may conduct a mathematical operation on the light information received from light 36, so as to determine the number of drops to be ejected into each compartment of liquid receiving device 22, such as into each of the individual wells 24 of a well tray 26, with each well 24 receiving different intended volumes, as one example. Controller 40 may include a database of information such as electronically or otherwise stored graphs, tables, and the like that correlate different types of information, such as a correlation of turn-on-energy to water content of DMSO solutions, for example. In the embodiment shown, drop detection device 28 is a light based detection device. However, drop detection device 28 may be an electrostatic device, a capacitive device, an acoustic device, a magnetic detection device, an optical device, or any other drop detection device that will function for a particular application.

In one example embodiment, drop detection device 28 may be a light scattering drop detector including a light emitting device 30, with a 1 millimeter (mm) laser beam diameter Light detecting device 34 may be a single channel photocell or a photocell array that is capable of detecting up to 5,000 to 8,000 drop-events per second. Using a 0.1 mm laser beam diameter, the same detector may be capable of detecting up to 50,000 to 80,000 drop-events per second. As the drops 38 fall, light 32 from laser diode 30 illuminates the drop 38, and light 36 scattered from the drops is detected by photo cell 34. At a drop velocity at 10 m/second, the expected time-of-flight (TOF) of the drops is 100 micro seconds (μsec). In one embodiment the drops 38 may continue to fall into a drop collection reservoir (not shown) for later use in liquid dispensing device 10, such that the fluid is not wasted, or drops 38 may fall into a separate reservoir (not shown) to be collected for disposal. However, in the embodiment shown the drops 38 fall directly into a predetermined individual well, such as a well 24*a*, for example, of well tray 26 and real time processing is conducted to determine an additional number of drops to be dispensed into the particular well 24*a* so that well 24*a* will contain a minute, precise, predetermined and known volume of fluid 20.

In one example embodiment, drop detection devices 28 function as turn-on-energy detection devices by detecting the onset of the ejection of drops 38 as the controller 40 increases the energy supplied to printheads 14 until the ejection energy 52 is attained. Alternatively, the turn-on-energy detection devices 28 could be used to detect when drops 38 cease to be ejected when the controller 40 is used to gradually decrease the energy supplied to printheads 14. Controller 40 uses this turn on energy to conduct a mathematical operation, such as an empirical formula that may relate the turn on energy to the water content, or use an information database, to determine a water content of the drops 38 ejected. In other words, the firing parameter or parameters of the printheads may be independently varied and any resultant drop ejection may be monitored, and utilized in conjunction with a correlation curve (FIG. 2), or a drop ejection threshold, or a mathematical operation, to make a decision regarding the turn on energy of each printhead. The firing parameters may include the voltage amplitude, pulse duration, precursor pulses, pre-heating temperature, and the like.

The controller may then further conduct a determination of the drop volumes of the ejected drops 38 from an information database or a mathematical operation that correlates water content to drop volume of the ejected drops. In one example method the turn on energy (TOE) may be measured, which may then be used to determine the water content. The water content may then be used to determine the drop volume, which may then be used to determine the intended number of drops. The controller may conduct the determination of the total number of drops to be ejected from an information database or mathematical operation that correlates or calculates total intended volume to the total number of drops to be ejected for a particular drop volume. In this manner, precise volume amounts of fluid 20, with previously unknown water content, can be placed into individual wells 24*a* and the like of a well tray 26 during real time processing of drop ejection information to provide quick, efficient and accurate liquid dispensing. The turn-on-energy information may be received by drop detection devices 28 during real-time operation or before real-time operation, as part of a setup or calibration routine. An example method will now be described with respect to FIGS. 2-5.

Figure 2:
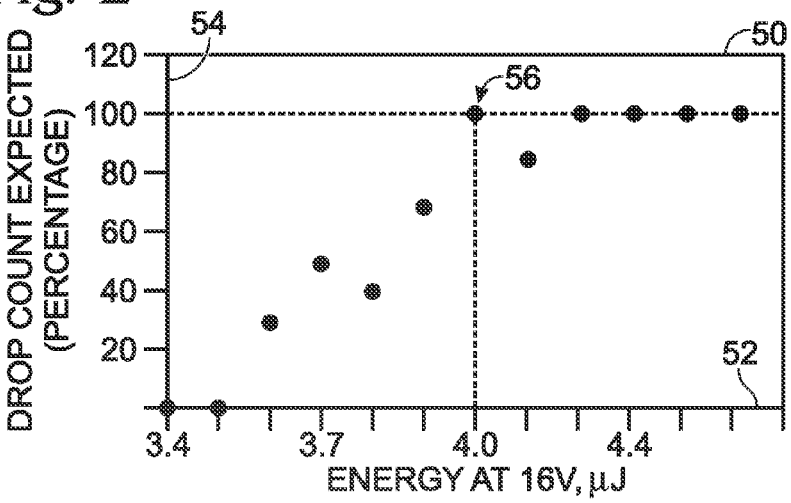
FIG. 2 is a graph showing results of one embodiment of a turn-on-energy determination showing the percentage of expected drops counted for each of the various ejection energy levels.
Figure 3:
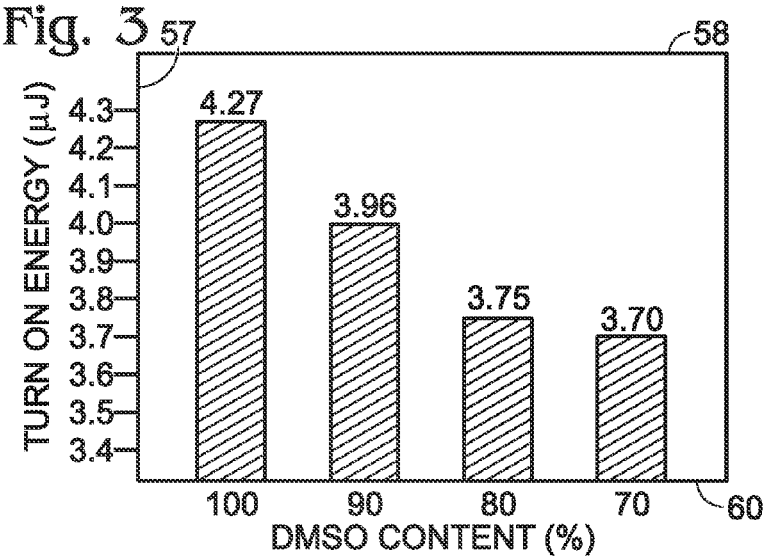
FIG. 3 is a table showing for one embodiment a correlation between the turn-on-energy for DMSO drops determined from FIG. 2 and the water content of the drops.

FIG. 2 is a graph 50 showing a correlation between the ejection energy 52 of a drop 38 from printhead 14, and the detected drop count 54, measured as a percentage of the expected drop count. In the example embodiment shown, ten drops 38 were attempted to be ejected from a single or multiple orifice 18 of printhead 14 at an energy of 3.4 micro joules, for example. Drop detection device 28 detected no drops at this energy level, i.e., a zero percentage of expected drops. Ten drops were then attempted to be ejected from a single or multiple orifice 18 of printhead 14 at an energy of 3.5 micro joules. Drop detection device 28 detected no drops at this energy level. Ten drops were then attempted to be ejected from a single or multiple orifice 18 of printhead 14 at an energy of 3.6 micro joules. Drop detection device 28 detected a 30% expected drop count, i.e., drop detection device detected three of the 10 expected drops. This process was repeated at increasing energy levels (the process may also be conducted starting at a high energy level and thereafter decreasing the energy level until drops are no longer ejected) until a plateau of 100% expected drops was detected. The initial onset of this plateau, at 4.0 micro joules in the example of graph 50, is determined to be the turn-on-energy 56 of the drops 38. Stated another way, detecting the turn-on-energy information may include detecting a number of drops ejected from an orifice or multiple orifices and then calculating the turn-on-energy as the energy at which the detected number of drops falls below a pre-established threshold relative to the intended number of drops. In the embodiment shown, the pre-established threshold was set at 100% of expected drops. The turn-on-energy 56 of the drops 38 may then be utilized by controller 40 to determine a water content of the drops, as shown in FIG. 3. Testing has found that ejecting a series of five drops or more at each energy level will yield accurate results for a determination of the turn-on-energy.

FIG. 3 is a graph 58 showing a correlation between a variety of turn-on-energy levels 57 of a DMSO drop 38 from printhead 14, and the water content 60 of the drops 38. In the example embodiment shown, a turn-on-energy level 57 of 4.0 volts corresponds approximately to a water content 60 of 10%, which may also be referred to, in the example embodiment shown, as a DMSO content of 90%. The water content 60 of the drops 38 may then be utilized by controller 40 to determine a drop volume of the drops, as shown in FIG. 4.

FIG. 4 is a table 62 showing a correlation between the water content 60 of DMSO drops 38 from printhead 14, and the drop volume 64 of the individual drops 38. In the example embodiment shown, a water content 60 of 10% (90% DMSO) corresponds to a drop volume 64 of 25 picoliters (pL) per drop. The drop volume 64 of the individual drops 38 may then be utilized by controller 40 to determine an exact number of drops 38 to be ejected into a particular well 24*a* of wall tray 26, as shown in FIG. 5.

FIG. 5 is a table 66 showing a correlation, at a particular total intended volume of 1,000 picoliters, between the particular drop volume 68, determined by the controller 40, in picoliters of drops 38 from printhead 14, and the total number of drops 70 that should be ejected to ensure the intended total volume within an individual well 24*a* of wall tray 26. For example, a desired total intended volume in a well 24*a* of 1,000 picoliters is achieved by ejecting a total of forty drops 38 into well 24*a* from printhead 14 when the drop volume is 25 pL. The total of forty drops may be calculated to include drops that previously have been dispensed into well 24*a*, such as during real time turn-on-energy calculations by controller 40. The turn-on-energy calculations may also occur prior to dispensing drops 38 into well tray 26. For this method, the drops ejected for the turn-on-energy determination would be dispensed into a drop collection reservoir for later disposal or into a well 24*a* which is later intended to have a sufficiently large dispensed volume. The number of drops dispensed into this well during the calibration step may be subtracted from the intended number of drops determined during the drop volume calibration. After the turn-on-energy and the correct number of drops required for each individual well 24*a* are determined, the dispensing into well tray 26 may proceed.

In this manner, a quick, efficient and accurate total number of drops 70 may be placed into multiple individual liquid receiving compartments 24 of a liquid receiving device on a large scale to achieve multiple intended total volumes. For example, minute and precise volumes of liquid 20 may be dispensed into the individual wells 24 of a well tray 26 that may include hundreds or thousands of individual wells 24, for example.

In other embodiments a light detection device may be utilized to determine the turn-on-energy of the drops utilizing algorithms such as waveform analysis of the detected drop quality, drop shape, and drop scattering information, for example.

Advantages of the turn-on-energy determination of the process described herein include a determination of the water content of DMSO solutions for example, the lack of use of fluid additives to enable drop detection, improved accuracy and precision of dispensed volumes, the speed of the drop volume calculation method, and the lack of use of expensive detection hardware. Moreover, this method may be used "on-line" or in "real-time" during filling of a well tray, or before filling a well tray during a set-up or calibration routine.

The information contained in FIGS. 2-5 is a very small sample shown for ease of illustration. In practice, much more information may be contained within the database or databases of controller 40 to allow the precise calculation of desired variables and quantities.

Other variations and modifications of the concepts described herein may be utilized and fall within the scope of the claims below.

We claim:

1. A liquid dispensing device (10), comprising:

a drop ejection device (12) including an orifice (18) adapted for ejecting drops therefrom above a particular turn-on-energy;

a turn-on-energy detection device (28) positioned to receive turn-on-energy information from said ejected drops of said drop ejection device as a function of energy applied to the drop ejection device; and a controller (40) that receives said turn-on-energy information and conducts a mathematical operation on said turn-on-energy information to determine a drop volume of said drops ejected.

2. The device (10) of claim 1 wherein said mathematical operation is a determination of a water content of said ejected drops from an information database that correlates turn-on-energy to water content of said ejected drops.

3. The device (10) of claim 2 wherein said mathematical operation further comprises a determination of said drop volume of said ejected drops from an information database that correlates water content to drop volume of said ejected drops and wherein said mathematical operation further comprises a determination of a total number of drops to be ejected, from an information database that correlates total ejection volume to drop volume of said ejected drops.

4. The device (10) of claim 1 wherein said drop ejection device (12) is chosen from one of a thermal ejection device, and a piezo ejection device and wherein said turn-on-energy detection device (28) is chosen from one of an electrostatic detection device, a capacitive detection device, an acoustic drop detection device, and an optical detection device.

5. The device (10) of claim 1 wherein said turn-on-energy detection device comprises a light scattering drop detection device including a light source chosen from one of a laser, a light emitting diode, and an arc discharge lamp, and a photodetector chosen from one of a photo diode, a CMOS, a charge-coupled device, and a photo multiplying tube.

6. The device (10) of claim 1 wherein said drops include one of DMSO, methanol, isopropanol, ethanol, glycerol, acetone, pyridine, tetrahydrofuran, acetonitrile, and dimethylformamide.

7. A method of dispensing liquid, comprising:

ejecting drops (20) from at least one orifice (18);

detecting turn-on-energy information from said ejected drops; and conducting a mathematical operation on said turn-on-energy information to calculate a drop volume of said ejected drops.

8. The method of claim 7 wherein said mathematical operation is a determination of a water content of said ejected drops (20) from predetermined information that correlates turn-on-energy to water content of said ejected drops.

9. The method of claim 7 wherein said mathematical operation further comprises a determination of said drop volume of said ejected drops (20) from predetermined information that correlates water content to drop volume of said ejected drops and wherein said mathematical operation further comprises a determination of a total number of drops to be ejected, from predetermined information that correlates total ejection volume to drop volume of said ejected drops.

10. The method of claim 7 wherein said step of detecting turn-on-energy information is conducted utilizing one of electrostatic detection, capacitive detection, acoustic drop detection, and optical detection.

11. The method of claim 7 wherein said detecting turn-on-energy is conducted with a light scattering drop detection device (28) including a light source chosen from one of a laser, a light emitting diode, and an arc discharge lamp, and a photodetector chosen from one of a photo diode, a CMOS, a charge-coupled device, and a photo multiplying tube.

12. The method of claim 7 wherein said detecting turn-on-energy information comprises detecting a number of drops (20) ejected from said at least one orifice (18) and calculating the turn-on-energy as the energy at which the detected number of drops falls below a pre-established threshold relative to the intended number of drops when the energy supplied to the said at least one orifice is being decreased, and as the energy at which the detected number of drops rises above a pre-established threshold relative to the intended number of drops when the energy supplied to the said at least one orifice is being increased.

13. The method of claim 7 wherein said conducting a mathematical operation is conducted during one of: conducted during real time filling of a multiple-well liquid receptacle (26), and wherein drops ejected during detecting the turn-on-energy test are subtracted from the total dispense volume required for each well; and, conducted prior to real time filling of a receptacle.

14. A method of manufacturing a liquid dispensing device (10), comprising:

providing at least one drop ejection device (12) including at least one orifice (18) adapted for ejecting drops therefrom;

positioning at least one turn-on-energy detection device (28) to receive turn-on-energy information as ejected drops are ejected from said at least one orifice of said drop ejection device; and connecting a controller (40) to said turn-on-energy detection device so as to receive said turn-on-energy information, said controller conducting a mathematical operation on said turn-on-energy information so as to calculate a drop volume of said ejected drops.

15. The method of claim 14, said method further comprising positioning a liquid receiving device (26) to receive an intended volume of said ejected drops, wherein said liquid receiving device is chosen from one of a biochemical testing device and a diagnostic strip device.

* * * * *